United States Patent [19]

Paulson et al.

[11] Patent Number: 4,621,847

[45] Date of Patent: Nov. 11, 1986

[54] SASH LOCK

[75] Inventors: Gary F. Paulson, Waseca; Gregory J. Vetter, Owatonna, both of Minn.

[73] Assignee: Truth Incorporated, Owatonna, Minn.

[21] Appl. No.: 681,490

[22] Filed: Dec. 13, 1984

[51] Int. Cl.[4] ..... E05C 3/10

[52] U.S. Cl. ..... 292/199; 292/241; 292/DIG. 33; 292/DIG. 47

[58] Field of Search ..... 292/199, 241, 242, 337, 292/202, 707, DIG. 70, DIG. 47, DIG. 35, DIG. 33, DIG. 20

[56] References Cited

U.S. PATENT DOCUMENTS

| | | | |
|---|---|---|---|
| 36,524 | 9/1862 | Minor | 292/242 |
| 379,910 | 3/1888 | Rosentreter | 292/DIG. 20 X |
| 815,537 | 3/1906 | Kissinger | 292/241 |
| 837,811 | 12/1906 | Ebbeson | 292/241 |
| 3,422,575 | 1/1969 | Armstrong | 49/356 |
| 4,059,298 | 11/1977 | Van Klompenburg | 292/199 |
| 4,429,910 | 2/1984 | Anderson | 292/199 |
| 4,444,422 | 4/1984 | Donaldson et al. | 292/DIG. 70 X |

*Primary Examiner*—Robert L. Wolfe
*Assistant Examiner*—Russell W. Illich
*Attorney, Agent, or Firm*—Wood, Dalton, Phillips Mason & Rowe

[57] ABSTRACT

A sash lock for a casement window having a case with two sections of different height and with the lower level section having a top wall with a circular segment opening with a curved edge which receives a generally circular part of a rotatable operating member positioned in the opening and extending under a vertical wall interconnecting the two case sections of different height. The rotatable operating member has a curved edge of the same curvature as the curved edge of the case top wall opening as well as a peripheral flange underlying the curved edge of the top wall opening whereby in all rotative positions of the planar operating member the opening is effectively sealed.

10 Claims, 6 Drawing Figures

4
52
70
25
50
66
72
31
60
6.
6.
85
80
51
12
65
30
71
73
10
4.
15
11

10
52
47
22
20
46
50
21
42
48
40
12
12
15
65

65
48
25
24
22
65
70
52
47
51
52
15

SASH LOCK

BACKGROUND OF THE INVENTION

This invention pertains to a sash lock for a pivotally mounted window and, more particularly, for a casement window. The sash lock is of a new and improved construction providing an effectively sealed transition between the interior and exterior of the case of the sash lock by means of an operating member which is exposed externally of the case and extends within the interior of the case and carries a movable lock member for coaction with a keeper. The exposed part of the operating member is shaped to remain in sealing relation with an opening in the top of the case.

A prior sash lock for a casement window is shown in Van Klompenburg U.S. Pat. No. 4,059,298, owned by the assignee of this application. In the prior sash lock, a generally planar operating member carries a lock member positioned within the case of the sash lock for coaction with a keeper and a portion of the generally planar operating member extends through an elongate opening defined by vertically-spaced walls of a section of the case and mounts a handle which can move along the length of the elongate opening between two operative positions in which the sash lock is either in lock or unlocked positions.

In the prior sash lock, there is a vertical wall with an opening in which a generally circular part of the planar operating member is disposed and a pair of vertical edges at the sides of the opening lie closely adjacent to the periphery of the circular part of the planar member in an effort to seal this opening between the interior and exterior of the sash lock case. Additionally, there is a disc-shaped spring fitted on the pivot mounting for the operating member positioned between the underside of the case top wall and the upper surface of the circular part of the planar operating member to hold the planar operating member in adjusted position and also to further effect a seal between the interior and exterior of the case. This prior sash lock has not effectively precluded passage of insects from the interior of the case to the exterior thereof.

A modification of the prior sash lock is a nonhanded unit, in that it can be associated with either a right-hand or left-hand casement window by having two different lock positions wherein a lock member is associated with a keeper. This modification having two lock positions is shown in Anderson U.S. Pat. No. 4,429,910, also owned by the assignee of this application.

This last-mentioned patent discloses a structure wherein a bug entry problem does not arise since the handle is associated with a rotatable shaft passing through a circular opening in the top of the sash lock case and which has only rotational movement within the opening and can be effectively sealed.

The sash lock embodying the invention provides for effective sealing of an operating member of the sash lock which is positioned partly within the case and partly exteriorly thereof, without requiring extremely close tolerances between parts of the operating member and the case and a handle may be directly associated with the exposed part of the operating member.

SUMMARY OF THE INVENTION

A primary feature of the invention is to provide a new and improved sash lock having an operating member carrying a lock member disposed within a case of the sash lock and with a part of the operating member exposed to the exterior of the case and with the operating member and case being in closely interfitting relation to avoid any opening which could permit passage of insects therethrough.

In carrying out the foregoing, the sash lock has a case section with a top wall having an opening with a generally semicircular edge. A planar operating member has a pivot mounting within the case and a generally semicircular part located within the opening and with the edge of the part closely adjacent the edge of the opening and with the curvatures related to the pivot mounting of the operating member whereby the edges of the opening and the operating member remain closely adjacent to each other in all rotative positions of the operating member.

In addition to the foregoing structure, the planar operating member has a peripheral flange underlying the edge of the opening in the top wall of the case section to assist in effecting a seal between the operating member and the case.

An object of the invention is to provide a sash lock having a case with two sections, one section having an open interior in which a movable lock member is positioned, the other section being adjacent said first section and having a top wall with an opening which is a segment of a circle and having a curved edge, an operating member carrying said lock member, a pivot mounting for said operating member at a distance from the curved edge of said opening, said operating member having a part positioned to fill said opening and having a curved peripheral flange underlying said curved edge to close said opening, and a handle secured to the upper side of said operating member part.

Still another object of the invention is to provide a sash lock having a case with two sections of different height, the higher of said sections substantially enclosing a lock member, said lower section having a top wall with an opening with a curved edge, said case having a vertical wall connecting said two case sections with a part thereof overlying said opening whereby the interior of the higher section is accessible from the exterior of the lower section, and means for transmitting motion from the exterior of the case to the interior of said higher section while effectively sealing said opening including a rotatable generally planar operating member positioned in said opening and extending under said vertical wall part and having a curved edge with the same curvature as said curved edge of the top wall opening.

A further object of the invention is to provide a sash lock as defined in the preceding paragraph wherein said planar operating member has an outwardly-extending peripheral flange positioned beneath said top wall of the lower section of the case.

An additional object of the invention is to provide a sash lock having a case formed of an upper level section and a lower level section and a back plate, a pivot mounting on said back plate, an opening in an upper surface of said lower level section having a generally semi-circular edge with said pivot mounting as its center, a generally vertical wall interconnecting said upper and lower level sections and having an intermediate part extending downwardly to the level of said upper surface and overlying said opening, a generally planar operating member pivotally mounted on said pivot mounting and having a generally circular periphery with said pivot mounting as its center and positioned to be closely adjacent said semicircular edge to provide a movable transition between the exterior and the interior of the case while closing off the opening through the generally vertical wall provided by said intermediate part overlying said opening, a peripheral flange on said planar operating member underlying said semi-circular edge, a lock member carried by said planar operating member within the case upper level section, and a handle fixed to the upper side of that part of said planar operating member which is positioned in said opening.

DESCRIPTION OF THE PREFERRED EMBODIMENT

Figure 1:
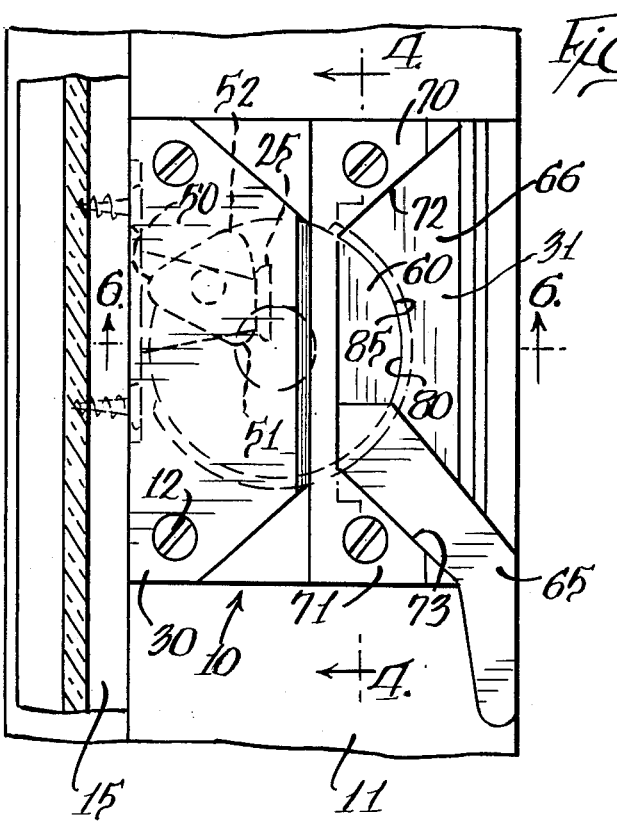
FIG. 1 is an elevational view of the sash lock, shown in association with a fragmentarily disclosed casement window and with the sash lock in a locked position.
Figure 2:
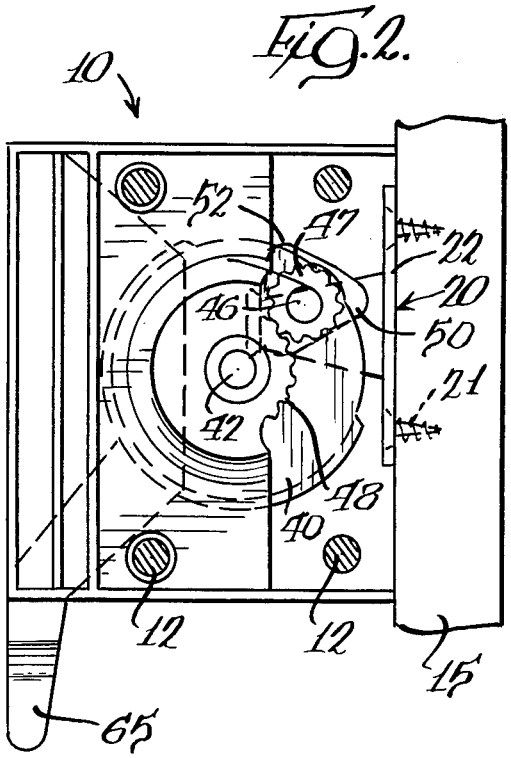
FIG. 2 is a bottom view of the sash lock, shown in association with the sash of the casement window, but with the casement window frame omitted and with the sash lock in the locked position.

The sash lock has a case, indicated generally at 10, which mounts to a vertical member 11 of a casement window frame by means of attaching screws 12. The case 10 mounts structure for locking a casement window sash 15 to the casement window frame by engagement with a keeper, indicated generally at 20, and which mounts to a window sash 15 by attaching screws 21 extending through a base plate 22 of the keeper. An outwardly-extending part 24 of the keeper 20 extends from an edge of the base plate 22 and has an inturned end 25 spaced from the base plate 22.

Figure 6:
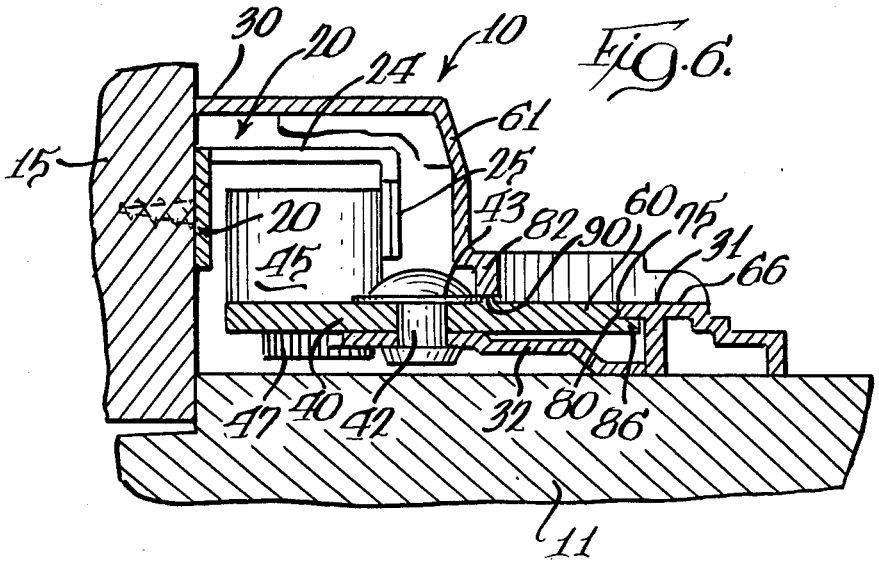
FIG. 6 is a sectional view, on an enlarged scale, taken generally along the line 6—6 in FIG. 1.

The case 10 has an upper level section 30 and a lower level section 31, with an underlying base plate 32 secured thereto by attachment to the lower end of tubular members 33 and 34, formed integrally with the case lower level section 31 and which are of a size to receive attaching screws 12. The upper level section 30 of the case opens to the rear of the sash lock whereby the keeper 20 may enter into the interior thereof, as seen in FIG. 6, for coaction with lock mechanism within the case.

The lock mechanism includes a generally planar operating member 40 pivotally mounted to the base plate 32 by a rivet 42. A spring washer 43 disposed between the head of the rivet and the upper surface of the planar operating member operates to hold the planar operating member in adjusted position.

The planar operating member rotatably mounts a lock member 45 which is fixed to a pin 46 rotatably mounted in the planar operating member and which extends therethrough and, at its lower end, is fixed to a gear 47 which meshes with an arcuate gear segment 48 formed along a curved edge of the base plate 32.

Figure 3:
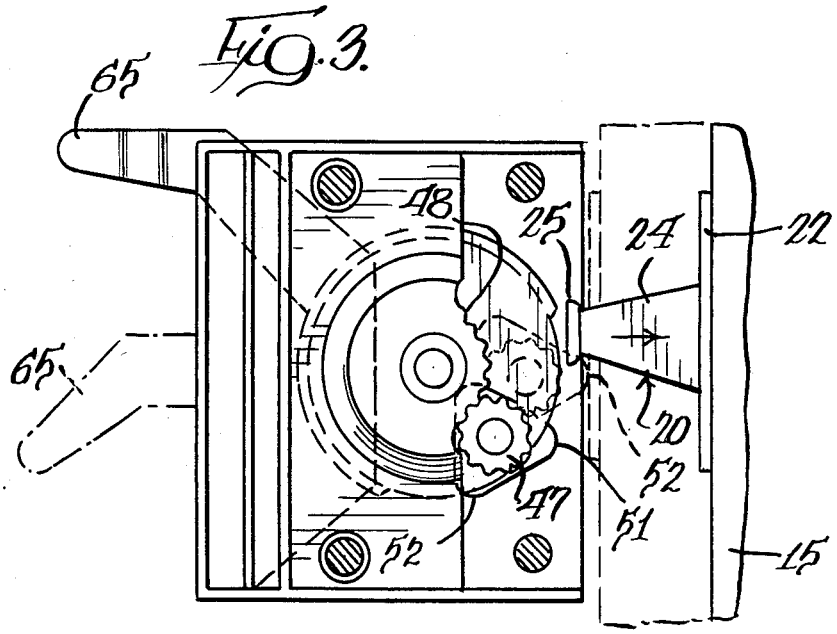
FIG. 3 is a view, similar to FIG. 2, showing the sash lock with parts in full line position in an unlocked position and in an intermediate position in broken line.
Figure 4:
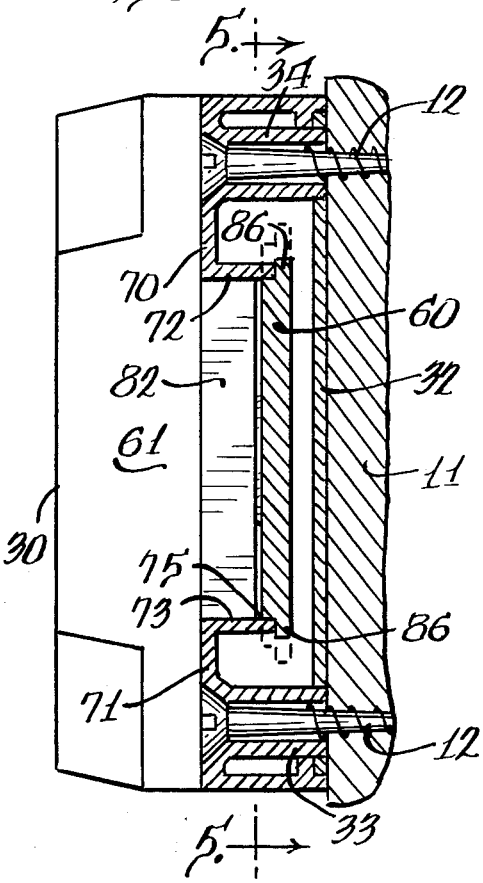
FIG. 4 is a sectional view, on an enlarged scale, taken generally along the line 4—4 in FIG. 1.

The lock member 45 is in the form of a triangularly-shaped cam having three rounded corners 50–52 with three flat surfaces extending one between each pair of rounded corners. With the sash lock in locked position, as shown in FIG. 1, a flat surface between the rounded corners 50 and 51 engages with the inturned end 25 of the keeper to hold the window sash in closed position. As seen in FIG. 3, with the lock mechanism in unlocked position, the lock member 45, in full line, has moved away from the keeper 20 whereby the window sash is free to move between open and closed positions.

The general operation of the lock member 45 is more particularly described in the aforesaid Anderson U.S. Pat. No. 4,429,910 and the disclosure thereof is incorporated herein by reference. The lock member 45 disclosed in this application distinguishes from that shown in the Anderson patent by having the third rounded corner 52 at the same distance from the mounting shaft 46 as the rounded corners 50 and 51 whereby, as the sash lock moves from locked to unlocked position, the rounded corner 52 can exert an opening force on the window sash by engaging the base plate 22 of the keeper 20, as seen in broken line in FIG. 3.

Figure 5:
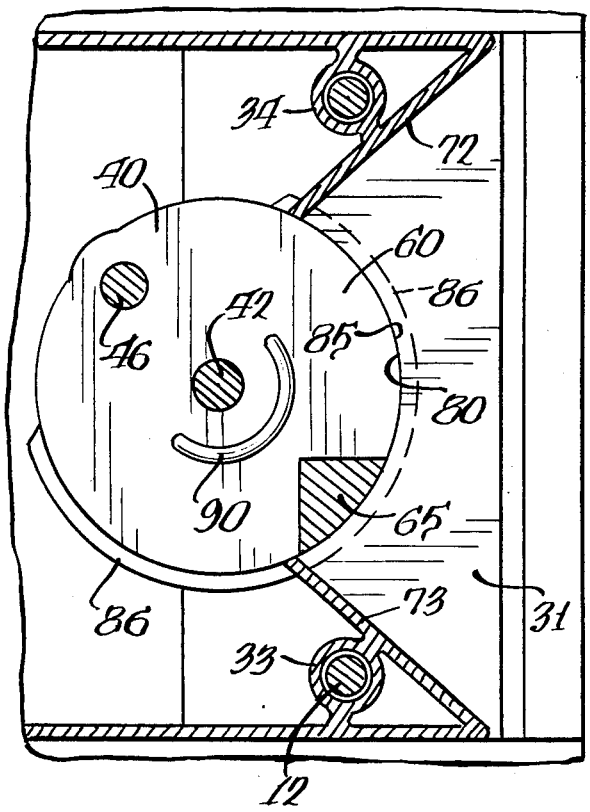
FIG. 5 is a sectional view, taken generally along the line 5—5 in FIG. 4.

The generally planar operating member 40, as seen in FIG. 5, has a generally circular periphery, with the pivot axis defined by the rivet 42 being the center of curvature. The rivet 42 and a portion of the planar operating member lie within the interior of the case upper level section 30, with a generally circular section 60 thereof extending outwardly of a vertical wall 82 extending between the case upper level section 30 to the case lower level section 31. The generally circular section 60 of the planar operating member has a handle 65 fixed to the upper side thereof for movement between locked and unlocked positions above the surface of a top wall 66 of the case lower level section 31. The top wall 66 has a pair of raised sections 70 and 71, with converging faces 72 and 73, respectively, extending upwardly from the top wall 66 and which define limit positions for the handle 65. The inner ends of these walls or surfaces 72 and 73 terminate at an opening 75 in the top wall 36 of the case lower level section 31 which is shaped as a segment of a circle and has a generally semicircular edge 80.

The vertical wall 82 terminates above the opening 75 in the top wall 66 of the lower level section 31 of the case as seen in FIG. 6 whereby the planar operating member 40 and, particularly the generally circular section 60 thereof, can make a transition between the two different level sections of the case. The generally circular section 60 of the planar operating member has the circular edge 85 which, with the edge 80 of the opening, lie on circles having a curvature with the axis of rotation about the rivet 42 being the center of curvature. As seen in FIG. 5, as the handle 65 moves in a counterclockwise direction from the position shown, the edges 80 and 85 remain in closely adjacent relation.

To assure a continuous seal of the operating member to the case, a peripheral flange 86 extends outwardly from the circular edge 85 of the planar operating member and beneath the top level thereof to underlie the edge 80 of the opening in the lower level section top wall 66 in all rotative positions of the operating member.

A raised curved ridge 90 on the upper side of the generally circular section 60 has a curvature with the pivot axis at rivet 42 as its center and underlies an innermost part of the vertical wall section 82 and slidably engages therewith to assure that the exposed upper face of the planar operating member does not come into rubbing contact with the underside of the vertical wall 82.

From the foregoing description, it will be evident that a sash lock has been disclosed wherein an operating member can make a sealed transition between the exterior of a sash lock case to the interior thereof for operation of lock mechanism. This is achieved by a generally circular section 60 of the planar operating member being disposed within an opening in the top wall 66 of the case which is shaped as a segment of a circle and extending under the vertical wall 82 and having a circular edge 85 as well as the peripheral flange 86 which coact with the circular edge 80 of the top wall opening in all rotative positions of the planar operating member.

We claim:

1. A sash lock having a case with two sections, one section having an open interior in which a movable lock member is positioned, the other section being adjacent said first section and having a top wall with an opening which is a segment of a circle and having a curved edge, an operating member carrying said lock member, a pivot mounting for said operating member at a distance from the curved edge of said opening, said operating member having a part positioned to fill said opening and having a curved peripheral flange underlying said curved edge to close said opening, and a handle secured to the upper side of said operating member part.

2. A sash lock having a case, a locking cam positioned within the case for coaction with a keeper, a planar operating member pivotally mounted on the case for movement about a pivot axis and carrying said locking cam, said case having upper and lower level sections with said locking cam and a first part of the planar operating member being within the upper level section and said lower level section having a top wall with an upper surface generally level with the top of a second part of the planar operating member extending out from said upper level section, said top wall having an opening with a semicircular edge with a center of curvature at said pivot axis and said planar operating member second part having a curved periphery with a center of curvature at said pivot axis to movably fit within and maintain said top wall opening closed in all rotative positions of said planar operating member, and a handle fixed to the upper side of the second part of said planar operating member.

3. A sash lock as defined in claim 2 wherein said planar operating member has an outwardly-extending peripheral flange positioned beneath said top wall of the lower level section of the case.

4. A sash lock as defined in claim 3 including a handle fixed to the upper side of the generally planar operating member for movement above the top wall of the lower level section of the case.

5. A sash lock as defined in claim 2 wherein said locking cam is rotatable on said planar operating member and has three lobes with one of said lobes being operative to exert an outward push on said keeper.

6. A sash lock having a case formed of an upper level section and a lower level section and a back plate, a pivot mounting on said back plate, an opening in an upper surface of said lower level section having a generally semi-circular edge with said pivot mounting as its center, a generally vertical wall interconnecting said upper and lower level sections and having an intermediate part extending downwardly to the level of said upper surface and overlying said opening, a generally planar operating member pivotally mounted on said pivot mounting and having a generally circular periphery with said pivot mounting as its center and positioned to be closely adjacent said semi-circular edge to provide a movable transition between the exterior and interior of the case while closing off the opening through the generally vertical wall provided by said intermediate part overlying said opening, a peripheral flange on said planar operating member underlying said semi-circular edge, a lock member carried by said planar operating member within the case upper level section, and a handle fixed to the upper side of that part of said planar operating member which is positioned in said opening.

7. A sash lock as defined in claim 6 wherein said planar operating member has a raised curved ridge adjacent the pivot mounting for engagement with a surface positioned inwardly of said vertical wall to maintain said planar operating member out of contact with a lower edge of said vertical wall.

8. A sash lock having a case, a locking cam positioned within the case for coaction with a keeper, a planar operating member pivotally mounted on the case for movement about a pivot axis to cause operation of said locking cam, said case having upper and lower level sections with said locking cam and a first part of the planar operating member being within the upper level section and said lower level section having a top wall with an upper surface generally level with the top of a second part of the planar operating member extending out from said upper level section, said top wall having an opening with a semi-circular edge with a center of curvature at said pivot axis and said planar operating member second part having a curved periphery with a center of curvature at said pivot axis to movably fit within and maintain said top wall opening closed in all rotative positions of said planar operating member, and a handle fixed to the upper side of the second part of said planar operating member.

9. A sash lock as defined in claim 8 including a peripheral flange on said planar operating member second part underlying said top wall edge.

10. A sash lock as defined in claim 8 wherein said locking cam is rotatable on said planar operating member and has three lobes with one of said lobes being operative to exert an outward push on said keeper.

* * * * *